United States Patent [19]

Wassenhoven

[11] Patent Number: 4,586,325

[45] Date of Patent: May 6, 1986

[54] METHOD AND DEVICE FOR PIECING ON A THREAD IN FRICTION SPINNING MACHINES

[75] Inventor: Heinz-Georg Wassenhoven, Monchen-Gladbach, Fed. Rep. of Germany

[73] Assignee: W. Schlafhorst & Co., Monchen Gladbach, Fed. Rep. of Germany

[21] Appl. No.: 733,217

[22] Filed: May 10, 1985

[30] Foreign Application Priority Data

May 10, 1984 [DE] Fed. Rep. of Germany ..... 3417308

[51] Int. Cl.[4] ..... D01H 15/00; D01H 7/885; D01H 7/892

[52] U.S. Cl. ..... 57/263; 57/301; 57/401

[58] Field of Search ..... 57/301, 401, 300, 400, 57/261, 263

[56] References Cited

U.S. PATENT DOCUMENTS

| | | | |
|---|---|---|---|
| 4,202,163 | 5/1980 | Turk et al. | 57/401 |
| 4,367,623 | 1/1983 | Parker et al. | 57/263 |
| 4,380,892 | 4/1983 | Parker et al. | 57/263 X |
| 4,441,310 | 4/1984 | Parker et al. | 57/401 |
| 4,514,972 | 5/1985 | Stahlecker | 57/401 X |

*Primary Examiner*—Donald Watkins

*Attorney, Agent, or Firm*—Herbert L. Lerner; Laurence A. Greenberg

[57] ABSTRACT

A method for piecing on a thread in friction spinning machines, having at least one friction surface with a perforated wall defining a spinning wedge at the wall includes moving the friction surface, eliminating the movement of transport air through the perforated wall of the friction surface, supplying fibers to the spinning wedge, sucking away the fibers, subsequently moving a thread to be pieced on into the spinning wedge, resuming suction of transport air through the perforated wall of the friction surface, ending suction of the fibers, and continuously withdrawing the thread from the spinning wedge, and a device for carrying out the method.

18 Claims, 2 Drawing Figures

METHOD AND DEVICE FOR PIECING ON A THREAD IN FRICTION SPINNING MACHINES

Figure 1:
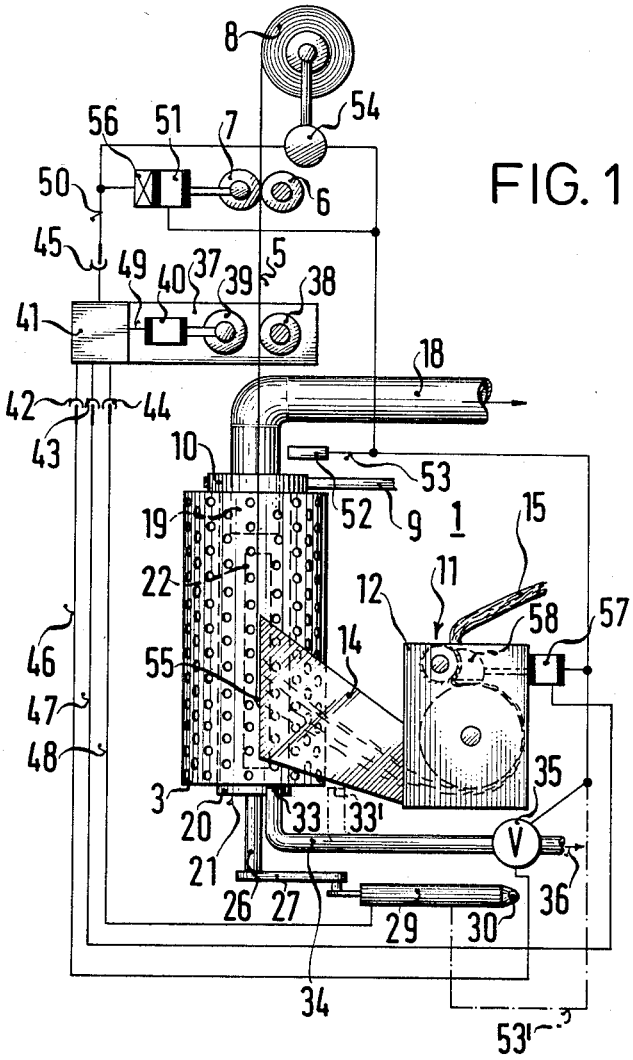

The invention relates to a method and a device for piecing on or starting a thread in friction spinning machines.

In friction spinning machines, the joining or starting of a thread presents problems, especially when the thread breaks. In order to re-start the thread it is necessary to introduce the thread into the spinning wedge, then to attach spinning fibers to the thread and, and finally to withdraw the thread again from the spinning wedge.

Generally, an irregularity in the thread is generated at the place where the thread is joined or pieced. In order to avoid the irregularity reducing the strength of the thread, it must be ensured that this irregularity is a thicker portion. However, thick portions are detrimental when further processing the thread to form texiles and they result in flaws in the finished product.

It is accordingly an object of the invention to provide a method and device for piecing on a thread in friction spinning machines, which overcomes the hereinaforementioned disadvantages of the heretofore-known devices of this general type, and to perform the piecing of the thread reliably with simple means, especially after a threadbreak, so that a thread joint of high quality is obtained and the number of unsuccessful attempts is kept as low as possible.

With the foregoing and other objects in view there is provided, in accordance with the invention, a method for piecing on or starting a thread in friction spinning machines, having at least one friction surface with a perforated wall defining a spinning wedge at the wall, which comprises moving or continuing the motion of the friction surface, eliminating the movement of transport air through the perforated wall of the friction surface, supplying or continuing to supply fibers to the spinning wedge, sucking away the fibers from the spinning wedge, subsequently moving a thread to be pieced on into the spinning wedge, resuming suction of transport air through the perforated wall of the friction surface, ending suction of the fibers, and continuously withdrawing the thread from the spinning wedge.

In accordance with another mode of the invention in a spinning machine having a fiber guiding channel for supplying the fibers to the spinning wedge, there is provided a method which comprises performing the step of sucking away fibers from the spinning wedge by sucking away fibers from the fiber guiding channel.

According to this method, the piecing on or joining of a thread is accomplished especially well, because the friction surfaces are already moving at the operational speed, because the fiber feed takes place under operating conditions and because the moment when the thread is pieced on is not dependent on the relative velocity of the friction surfaces, on the controlled rate of the fiber feed, or on the increasing speed of the above-mentioned parts. Once the thread end lies in the spinning wedge, the spinning fibers attach themselves to the thread end with a twisting action, only after the thread friction begins again, due to the suction of the transport air which is re-applied. The thread withdrawal can be started again or increased, to the same extent to which the transport air is sucked through the perforated wall of the friction surface again, and the suctioning away of fibers (from the spinning wedge) is reduced. In this way, a good, durable, and unnoticeable thread joint is formed. The piecing on of the thread can be performed as slowly as desired, depending on the specified quality of the thread connection. If the piecing on of the thread is done immediately after a thread break, the fiber feed does not have to be interrupted at all.

In accordance with a further mode of the invention in a spinning machine having a suction nozzle on the friction surface directed toward the spinning wedge for sucking air from the spinning wedge, the method comprises moving the suction nozzle into a position out of and directed away from the spinning wedge while transport air is being suctioned, for interrupting the suction of the transport air through the perforated wall of the friction surface. This is done to cause an interruption of the suction of the transport air through the perforated wall of the friction surface.

Consequently it is not necessary to choke or turn off the suction. It is sufficient to simply swing the suction nozzle in such a way that it does not have any effect on the spinning wedge. This method is also advantageous when the thread joining is to be performed at a spinning station of a spinning machine having many spinning stations. The suction system and its effectiveness and influence on the whole spinning machine is in no way reduced, because no reduction of the suction flow, or operation of the suction valves or the like, is necessary. The starting of one spinning station has no effect on the air supply for the remaining spinning stations.

In accordance with an added mode of the invention in a spinning machine having a controllable roller pair operable in forward and reverse direction, there is provided a method which comprises moving the thread to the spinning wedge and subsequently withdrawing the thread with the roller pair.

In accordance with an additional mode of the invention in a spinning machine having a thread withdrawal device, there is provided a method which comprises transferring the thread from the roller pair to the thread withdrawal device of the station after the thread reaches a withdrawal velocity for normal spinning operation. This is done because in the parallel operation of many spinning stations of a spinning machine, their thread withdrawal devices also run in parallel or have a common drive shaft, and it is advantageous to use a special (separate) pair of spinning starting rollers with control and shifting means for starting the spinning operation.

In order to carry out the method, there is provided a device for piecing on a thread in friction spinning machines, comprising at least one friction surface having a perforated wall, means for moving the friction surface defining a spinning wedge at the perforated wall, means for supplying fibers to the spinning wedge, a first controllable transport air suction device for suctioning transport air through the perforated wall, a second controllable transport air and fiber suction device for suctioning away transport air and fibers, and means for feeding and withdrawing a thread from the spinning wedge.

In accordance with another feature of the invention, there is provided a device for piecing on a thread in friction spinning machines, comprising spinning stations, friction surfaces movable in opposite directions at one of the spinning stations for forming a spinning wedge, at least one of the friction surfaces being a rotatable sieve drum having a perforated wall, means for supplying fibers to the spinning wedge, means for withdrawing a thread from the spinning wedge, a first transport air suction device having a suction nozzle being variable in position for suctioning air from the spinning wedge through the perforated wall, and a second controllable transport air and fiber suction device for suctioning away transport air and fibers.

In accordance with a further feature of the invention, the second suction device is directed toward the spinning wedge.

In accordance with an added feature of the invention, the fiber supplying means are in the form of a fiber guiding channel, and the second suction device is connected to the fiber guiding channel.

For instance, when starting the operation, or after the thread has broken, the special controllable suction device for the transport air and the fibers can first be set in operation to act upon the spinning wedge from the outside. The suction nozzle then moves away from the spinning wedge and the transport air along with the fiber material enters into the special suction device. This takes place in a timewise coordination with the introduction of the thread into the spinning wedge for the purpose of attaching spinning fibers to the thread end. However, this does not mean that the thread must be already positioned in the spinning wedge when the suction devices are switched. It is simpler if the thread is brought into the spinning wedge after the suction devices have been switched. The introduction of the thread and the introduction and forming of the thread end can be ensured or facilitated by the special suction device if this suction device acts all the way toward the back of the spinning wedge, i.e. at the end thereof opposite the end where the thread is withdrawn. In this case the special suction device can suck in the thread end, or is capable of newly forming the thread end and of holding it until the thread withdrawal is started after fibers have attached themselves, and the twisting of the thread has begun.

In accordance with an additional feature of the invention, the sieve drum has an axis of rotation, and the suction nozzle or a support tube therefor is pivotable about the axis of rotation. This pivoting of the suction nozzle around the rotation axis of the sieve drum is especially advantageous, because in this case the end of the nozzle is always kept at a predetermined distance away from the inner wall of the sieve drum.

In accordance with again another feature of the invention, the friction surfaces are two sieve drums having perforated walls, and the first suction device has suction nozzles at both of the perforated walls, and including means for operating the suction nozzles in common. In the prior art friction spinning machines, both friction surfaces which move relative to each other are formed by sieve drums, and it is therefore advantageous if the suction nozzles of the two sieve drums have a common operating device. This not only simplifies their operation, but also guarantees the synchronous control of the suction nozzles.

In accordance with again a further feature of the invention, there is provided a controllable roller pair for starting a spinning operation, the roller pair bringing the thread into the spinning wedges in forward direction and withdrawing the thread subsequently in reverse direction as required. For example, such a roller pair for starting spinning can be a part of a device for starting spinning which can travel from spinning station to spinning station.

Although the time at which the thread is pieced is independent of the time at which the suction devices were shifted before, it is still advantageous to coordinate the shifting of the suction devices and the withdrawal of the thread. When shifted back, the suction nozzles do not move the operating position suddenly, but rather steadily, and the thread withdrawal can be increased corresponding to their increased influence on the spinning wedge. This coordination can be achieved by a special control device.

In accordance with again an added feature of the invention, there is provided an operating device for the roller pair or thread withdrawal means, a common control device for coordinating an operating cycle, and operative connections from the common control device to the second suction device, to the operating means, and to the operating device for the roller pair.

During the time that the special suction device is acting on the fiber guiding channel or on the spinning wedge, its effectiveness should not be decreased by misdirected air currents. Therefore, in accordance with a concomitant feature of the invention, the suction nozzle includes at least one shield or baffle, the nozzle being movable from a position where it is directed toward the spinning wedge into a position wherein it is directed away from the spinning wedge and the shield is directed toward the spinning wedge allowing surrounding air to enter the nozzle. The shields prevent too much air from being sucked into the suction device through the perforations in the shell of the sieve drum.

Other features which are considered as characteristic for the invention are set forth in the appended claims.

Although the invention is illustrated and described herein as embodied in a method and device for piecing on a thread in friction spinning machines, it is nevertheless not intended to be limited to the details shown, since various modifications and structural changes may be made therein without departing from the spirit of the invention and within the scope and range of equivalents of the claims.

Figure 2:
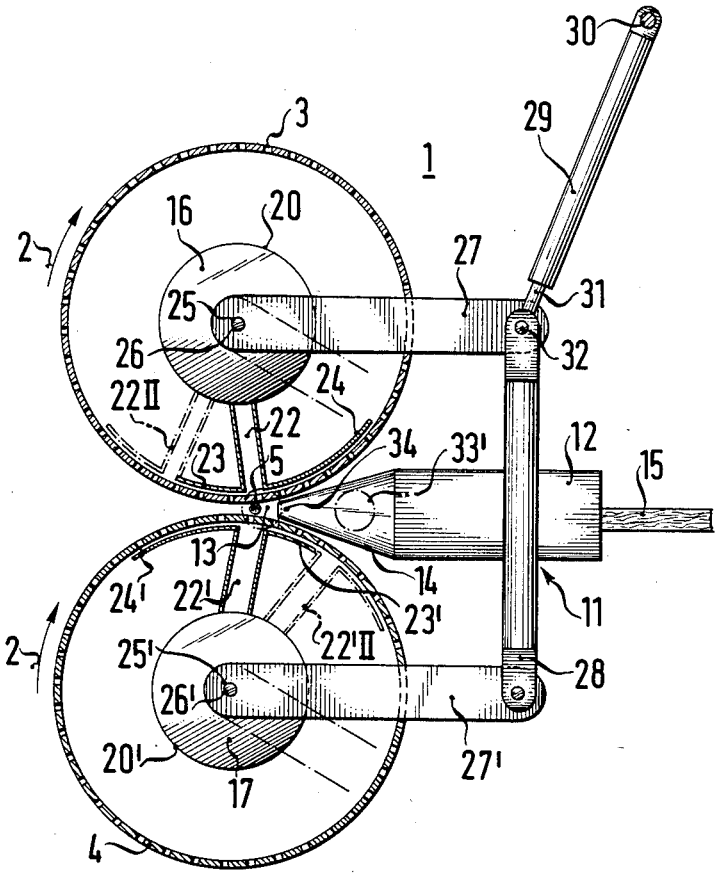

The construction and method of operation of the invention, however, together with additional objects and advantages thereof will be best understood from the following description of specific embodiments when read in connection with the accompanying drawings, in which:

FIG. 1 is a fragmentary, diagrammatic, top-plan view of a friction spinning station; and FIG. 2 is a side-elevational view of the configuration of the sieve drums on an enlarged scale.

Referring now to FIGS. 1 and 2 of the drawings in detail as a whole, it is seen that a spinning station 1 has two perforated or sieve drums 3 and 4 which can rotate in the same rotational sense or direction, which is the direction of the arrows 2. The two sieve drums 3 and 4 form friction surfaces moving in opposing directions for a thread 5 which is to be produced at the spinning station. According to FIG. 1, the thread 5 is conducted over a pair of withdrawal rollers 6, 7 to a cross-wound bobbin or cheese 8 which accepts the thread.

The sieve drums 3 and 4 are driven by drive belts, according to FIG. 1. For example, the sieve drum 3 is driven by a drive belt 9 which runs over a belt pulley 10 that is connected with the sieve drum 3.

The spinning station 1 includes a thread feeding device 11, formed of a thread loosening device 12 and a fiber guiding channel 14 which extends into a spinning wedge 13. Fibers as well as transport air flow through the channel 14.

The fiber loosening device 12 dissolves sliver 15 which has been supplied into individual fibers, which are then transported into the spinning wedge 13 by the transport air.

The interior of each of the two sieve drums 3 and 4 is provided with a transport air-suction device. The sieve drum 3 is associated with a transport air-suction device 16 and the sieve drum 4 is associated with a transport air-suction device 17. The two transport air-suction devices 16 and 17 are similarly constructed in principle. For example, the transport air-suction device 16 has a suction pipe connection 18 with a pipe end 19 that protrudes into the sieve drum 3. A support tube 20 which can swing over a small angle is supported at the pipe end 19. The support tube 20 is closed at the end thereof opposite the pipe 18 by a lid 21. A long, narrow suction nozzle 22 extends from the support tube 20 to a location close to the shell of the sieve drum 3. The suction nozzle 22 has two curved shields at the end thereof, namely a shorter shield 23 and a longer shield 24. The lid 21 of the support tube 20 carries a rod 26 which is aligned in the direction of the axis of rotation 25 of the sieve drum 3. The rod 26 is connected with a lever 27.

In a similar construction, but in mirror image form, the support tube 20' of the transport air-suction device 17 carries a suction nozzle 22', provided with shields 23' and 24'.

The support tube 20' is also connected with a lever 27' by a rod 26', which is aligned with the axis of rotation 25' of the sieve drum 4. A coupling link 28 causes the two levers 27 and 27' to articulate with each other, so that they can be operated by common operating means 29. The operating means 29 are formed of a pneumatic piston-cylinder device which is pivotally supported at a pivot point 30. During operation, a piston rod 31 is moved forward and acts upon an articulation point 32 of the lever 27. After the piston rod 31 has moved forward, the lever 27 moves to the position shown in dot-dash lines, and the suction nozzle 22 also moves to the position 22II indicated by dot-dash lines. Since the lever 27' is simultaneously moved to the dot-dash position, the suction nozzle 22' also moves to the dot-dash position 22'II. With regard to the configuration of the shields, it is a special advantage to swing the suction nozzle around the axes of rotation of the sieve drums, so that the distance from the shields to the walls of the sieve drums always remains the same.

FIG. 1 shows that a mouth or termination 33 of a special controllable suction device 34 for the transport air and the fibers is provided at the height or level of the spinning wedge. The suction device 34 is connected to a control valve 35, and when this valve is opened, air flows or is sucked into the orifice or termination 33 and is discharged in the direction of an arrow 36.

FIG. 1 also shows that a device 37 is provided for starting the spinning operation, which can travel from spinning station to spinning station. The device 37 is used for bringing the thread 5 into the spinning wedge 13 and for the subsequent withdrawal of the thread. The device 37 has a spinning initiating roller pair 38, 39, which can be controlled for forward and reverse operation. A contact roller 39 of the roller pair can be pressed against a driven roller 38 of the roller pair by an electro-magnetic actuator 40. The device 37 for starting spinning is also provided with a control box 41 which controls the motion cycle of the individual work operations according to a program or timer. For this purpose, the control device 41 has operative connections to the various operating devices through removable or quick-connect terminals 42 to 45. There is an operative connection 46 to the valve 35, an operative connection 47 to an electro-magnetic drive 57 of a sliver feeding device 58 of the fiber feeding device 11, an operative connection 48 to the operating means 29, a direct operative connection 49 to the electro-magnetic drive 40 and an additional operative connection 50 to another magnetic drive 51, which contacts or lifts the roller 7 of the withdrawal roller pair 6, 7 against the driven roller 6.

In order to piece on or start the thread, and especially remedy a broken thread, the procedure is as follows:

After a thread monitor 52 has sensed that a thread is missing, it triggers the electro-magnetic drives 51 and 57, a spool drive 54 and the valve 35 over a branched operative connection 53. This is done in order to stop further thread withdrawal and thread take up, to stop the feeding of the sliver, and to start the operation of the suction device 34. The contact roller 7 is lifted from the roller 6, the bobbin 8 stops, and the valve 35 opens. Meanwhile, the sieve drums 3 and 4 continue to run. Fibers which are still present are sucked into the suction device 34. A branch line 53' of the operative connection 53, indicated by dot-dash lines, leads to the operating means 29, indicating that the thread monitor 52 in an alternate configuration is also capable of instantly switching the position of the suction nozzles 22 and 22', so that the suction effect in the spinning wedge 13 may be stopped.

If it is assumed that the thread end has not been taken up by the cross-wound bobbin 8 (in which case it would have to be located and guided back), the device 37 can start the spinning operation. The device 37 is moved to the friction spinning station 1, and it makes contact with the operative connections 46, 47, 48 and 50 over the connection terminals 42 to 45. The control device 41 controls the spinning station 1 according to a program or a timer, i.e. it operates the valve 35 (unless it was already operated by the thread monitor 52), it operates the operating means 29 (if it was not already operated by the thread monitor 52), it turns on the sliver feeding device 58 of the fiber feeding device 11 which is still running in order to supply it with fiber material, it places the contact roller 39 against the thread 5 and against the driven roller 38, and it sets the contact roller 39 for reverse rotation.

While the fibers emerging from the fiber guiding channel 14 into the spinning wedge 13 are continuously sucked into the suction device 34 and discharged, the thread end 55 travels comparatively slowly back into the spinning wedge 13, whereby it finally is taken in and held by the suction effect of the suction device 34. The thread end therefore splits into its individual fibers, which is helpful for the start of the spinning operation which follows. At this point, the control device 41 which has the proper speed, that is not too slow and not too fast but is continuous, sets backs or re-sets the operating device, and makes the driven roller 38 rotate in the forward direction with increasing velocity, for achieving an increasing thread withdrawal. The control device 41 also activates the spool drive 54 through the branch connection 50, in order to activate the drive of the bobbin 8 synchronously with the increasing withdrawal of the thread.

During these operational steps, an increasingly greater amount of fibers adhere to the end of the thread 5 and less and less fibers are discharged through the suction device 34, until when the two suction nozzles 22 and 22' have reached their operational position, the full friction of the thread is obtained, and all fibers reach the open thread end. The valve 35 is closed by the control device 41 and when the thread withdrawal velocity has reached the normal spinning speed, the electro-magnetic drive 51 is turned on through a starting delay element 56, and the withdrawal roller pair 6, 7 begins to operate. Simultaneously, the contact roller 39 is lifted from the driven roller 38 by the electro-magnetic actuator 40.

The thread joining operation is then finished and the device 37 for starting spinning can travel to another station of the spinning machine. For this purpose, the spinning initiating roller pair 38, 39 swings laterally out of the path of the thread, and out of the region of the spinning station 1. Details of the operation will not be described here, because they are not essential for an understanding of the invention.

The invention is not limited to the illustrated and described embodiment which was used as an example. For instance, the control device 41 could be provided at each spinning station. The functions of the spinning initiating roller pair 38 and 39 could also be fulfilled by the withdrawal roller pair 6, 7. In this way, the joining of the thread after a thread break could be achieved faster, because the spinning station 1 would not have to wait for the travelling device for starting the spinning operation.

The termination or orifice of the suction device 34 could alternately lie at a point 33', i.e. at the side of the fiber guiding channel 14. In this case, the fibers could not enter the spinning wedge 13 during the suction cycle. It is also conceivable to provide the suction device 34 with two terminations or orifices, one of which essentially guides the fibers out of the fiber guiding channel and the other of which applies suction to the thread ending.

In the illustrated and described embodiment, the two suction nozzles move in the same rotational sense and in different directions. In special cases, it can be practical to move the suction nozzles in the opposite sense, so that in the swung-out state, both terminate either in front of or behind the spinning wedge. In order to achieve this, the linkage of the levers 27, 27' could be changed, or an actuating device could be provided for each of the two levers.

The foregoing is a description corresponding in substance to German patent application No. P 34 17 308.0, filed May 10, 1984, the International priority of which is being claimed for the instant application and which is hereby made part of this application. Any material discrepancies between the foregoing specification and the aforementioned corresponding German application are to be resolved in favor of the latter.

I claim:

1. Method for piecing on a thread in friction spinning machines, having at least one friction surface with a perforated wall defining a spinning wedge at the wall, which comprises moving the friction surface, eliminating the movement of transport air through the perforated wall of the friction surface, supplying fibers to the spinning wedge, sucking away the fibers, subsequently moving a thread to be pieced on into the spinning wedge, resuming suction of transport air through the perforated wall of the friction surface, ending suction of the fibers, and continuously withdrawing the thread from the spinning wedge.

2. Method according to claim 1 in a spinning machine having a fiber guiding channel for supplying the fibers to the spinning wedge, which comprises performing the step of sucking away fibers from the spinning wedge by sucking away fibers from the fiber guiding channel.

3. Method according to claim 1, in a spinning machine having a suction nozzle on the friction surface directed toward the spinning wedge for sucking air from the spinning wedge, which comprises moving the suction nozzle into a position out of and directed away from the spinning wedge while transport air is being suctioned, for interrupting the suction of the transport air through the perforated wall of the friction surface.

4. Method according to claim 1, in a spinning machine having a controllable roller pair operable in forward and reverse direction, which comprises moving the thread to the spinning wedge and subsequently withdrawing the thread with the roller pair.

5. Method according to claim 4, in a spinning machine having a thread withdrawal device, which comprises transferring the thread from the roller pair to the thread withdrawal device after the thread reaches a withdrawal velocity for normal spinning operation.

6. Device for piecing on a thread in friction spinning machines, comprising at least one friction surface having a perforated wall, means for moving the friction surface defining a spinning wedge at said perforated wall, means for supplying fibers to said spinning wedge, a first controllable transport air suction device for suctioning transport air through said perforated wall, a second controllable transport air and fiber suction device for suctioning away transport air and fibers, and means for feeding and withdrawing a thread from said spinning wedge.

7. Device according to claim 6, wherein said second suction device is directed toward said spinning wedge.

8. Device according to claim 6, wherein said fiber supplying means are in the form of a fiber guiding channel, and said second suction device is connected to said fiber guiding channel.

9. Device for piecing on a thread in friction spinning machines, comprising spinning stations, friction surfaces movable in opposite directions at one of said spinning stations for forming a spinning wedge, at least one of said friction surfaces being a rotatable sieve drum having a perforated wall, means for supplying fibers to said spinning wedge, means for withdrawing a thread from said spinning wedge, a first transport air suction device having a suction nozzle being variable in position for suctioning air from said spinning wedge through said perforated wall, and a second controllable transport air and fiber suction device for suctioning away transport air and fibers.

10. Device according to claim 9, wherein said second suction device is directed toward said spinning wedge.

11. Device according to claim 9, wherein said fiber supplying means are in the form of a fiber guiding channel, and said second suction device is connected to said fiber guiding channel.

12. Device according to claim 9, wherein said sieve drum has an axis of rotation, and said suction nozzle is pivotable about said axis of rotation.

13. Device according to claim 9, wherein said sieve drum has an axis of rotation, and including a support tube for said suction nozzle being pivotable about said axis of rotation.

14. Device according to claim 9, wherein said friction surfaces are two sieve drums having perforated walls, and said first suction device has suction nozzles at both of said perforated walls, and including means for operating said suction nozzles in common.

15. Device according to claim 9, including a controllable roller pair for starting a spinning operation, said roller pair bringing the thread into said spinning wedge in forward direction and withdrawing the thread subsequently in reverse direction as required.

16. Device according to claim 14, including a controllable roller pair for starting a spinning operation, said roller pair bringing the thread into said spinning wedge in forward direction and withdrawing the thread subsequently in reverse direction as required.

17. Device according to claim 16, including an operating device for said roller pair, a common control device for coordinating an operating cycle, and operative connections from said common control device to said second suction device, to said operating means, and to said operating device for said roller pair.

18. Device according to claim 9, wherein said suction nozzle includes at least one shield, said nozzle being movable from a position wherein it is directed toward said spinning wedge into a position wherein it is directed away from said spinning wedge and said shield is directed toward said spinning wedge allowing surrounding air to enter said nozzle.

* * * * *